United States Patent [19]

Hight et al.

[11] 3,930,696

[45] Jan. 6, 1976

[54] TOILET PAPER STORAGE AND DISPENSER

[75] Inventors: Florence M. Hight; Duane D. Hight, both of Otis AFB, Mass.

[73] Assignee: The Raymond Lee Organization, Inc., New York, N.Y.

[22] Filed: Sept. 4, 1974

[21] Appl. No.: 503,052

[52] U.S. Cl. ..... 312/39; 312/213

[51] Int. Cl.[2] ..... B65H 19/00; A47B 75/00

[58] Field of Search ..... 312/39, 38, 211, 212, 213; 220/87; 4/1; 242/55.53

[56] References Cited

UNITED STATES PATENTS

| | | | |
|---|---|---|---|
| 478,702 | 7/1892 | Merritt | 220/87 |
| 1,486,957 | 3/1924 | England | 220/87 |
| 2,459,252 | 1/1949 | Strahan | 242/55.53 |
| 2,546,820 | 3/1951 | Grant | 242/55.53 |
| 2,728,604 | 12/1955 | Garfield | 242/55.53 |
| 3,171,135 | 3/1965 | Polichio | 4/1 |

*Primary Examiner*—Paul R. Gilliam
*Assistant Examiner*—Doris L. Troutman
*Attorney, Agent, or Firm*—Howard I. Podell

[57] ABSTRACT

A container with a suspended roller for dispensing toilet tissue, with storage space for a spare roll, and space to hold air freshener fitted within the container.

2 Claims, 4 Drawing Figures

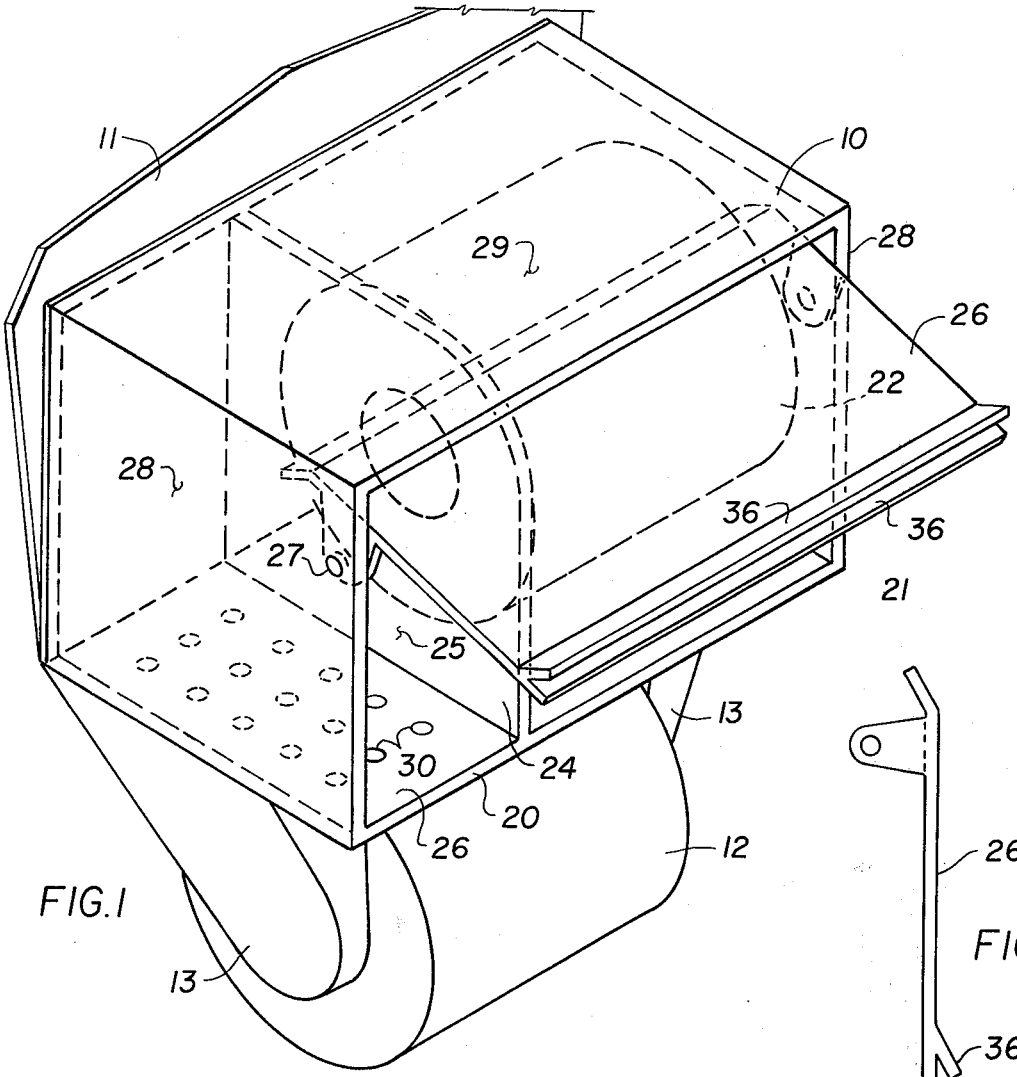
FIG.1
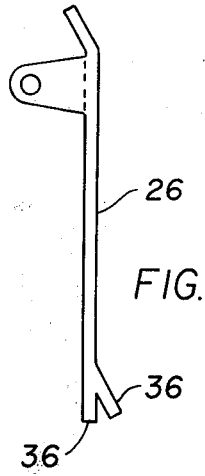
FIG.4
FIG.3
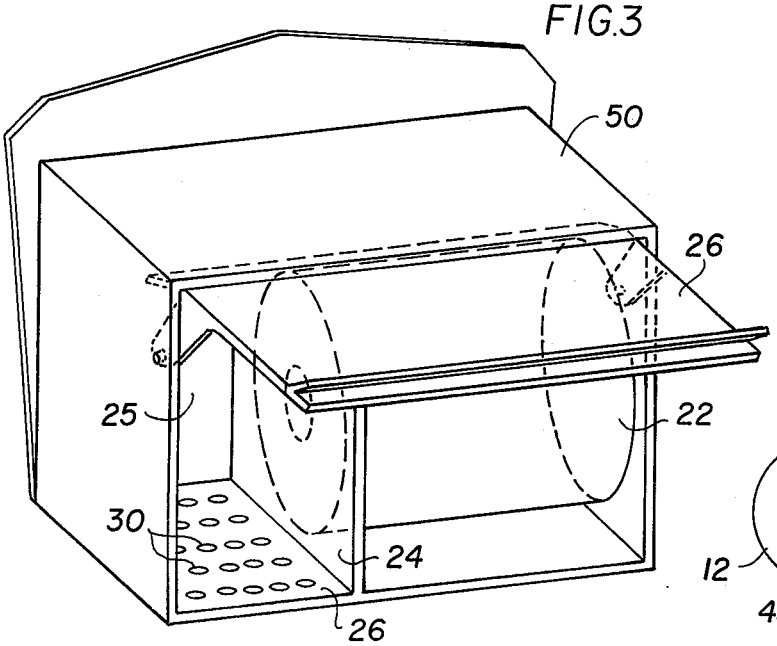
FIG.2
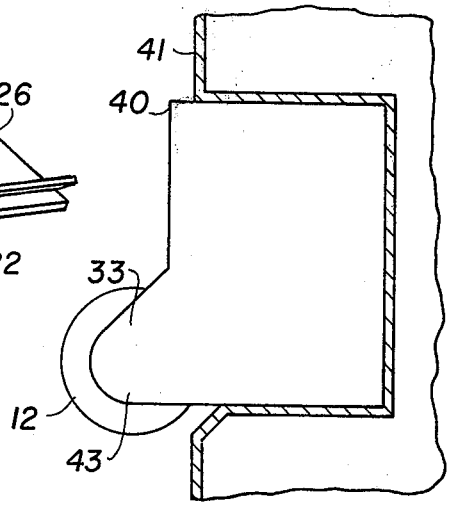

TOILET PAPER STORAGE AND DISPENSER

SUMMARY OF THE INVENTION

Our invention relates to a device for the dispensing and storage of toilet tissue, and particularly to a cabinet combining a suspended roller which holds a dispensing roll of tissue, and an enclosed space which contains a storage roll, and a perforated shelf for fitting a container of air freshener.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the combination dispenser and storage cabinet;

FIG. 2 is an end view of an alternate embodiment of the cabinet;

FIG. 3 is a perspective view of a still further alternate embodiment of the storage cabinet; and FIG. 4 is an end view of the cabinet door.

DESCRIPTION OF THE PREFERRED EMBODIMENT

Turning now descriptively to the drawings, in which similar reference characters denote similar elements throughout the several views; FIG. 1 shows the cabinet 10 mounted to a wall 11, with a dispensing roll 12 of tissue mounted on arms 13 below the container section 20.

Container section 20 is fitted with a compartment 21 of a size to hold a storage roll 22 of tissue, with an internal partition 24 separating the storage roll 22 from a recessed section 25 fitted with a bottom wall 26 in which through holes 30 are mounted for the storing of a deodorant or air freshener unit.

A door 26 is mounted on the front of the cabinet, pivoting about rivets 27 in the sides 28 of the cabinet so that the door in the open position is raised to lie parallel to the top side 29 of the cabinet. The bottom section of the door 26 is formed with a forked lip 36 so that the door may be readily grasped for opening or closing, as shown in FIGS. 1, 3 and 4.

As shown in FIG. 2, an alternate embodiment 40 of the cabinet may be fitted in a recess of a wall 41. Cabinet 40 is fitted with extension arms 43 for holding a dispensing roll 12 of tissue, with arms 43 projecting forward of the lower section of the cabinet 40.

FIG. 3 illustrates a storage cabinet 50 similar to the cabinet 10 of FIG. 1 except for the absence of mounting posts for a dispensing roll of tissue.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A cabinet for containing a storage roll of tissue and air freshener material mountable to the wall of a bathroom with means to dispense the stored air freshener material into the bathroom in which the device is installed comprising a cabinet fitted with a partition dividing the interior into a first compartment and a second compartment, said first compartment of a size to hold a roll of tissue and said second compartment of a size for the storage of air freshener material, with an exterior wall of said second compartment perforated for permitting passage of air through the perforations, in which the cabinet is fitted with a pivotable door that in the closed position serves as an external wall of both compartments.

2. The combination as recited in claim 1 in which external mounting arms are fitted to the cabinet for holding a dispensable roll of tissue.

* * * * *